US010942486B2

(12) United States Patent
Carpenter et al.

(10) Patent No.: US 10,942,486 B2
(45) Date of Patent: Mar. 9, 2021

(54) TONER CARTRIDGE HAVING POSITIONING FEATURES INCLUDING GUIDES EXTENDING OUTWARD FROM SIDES OF THE TONER CARTRIDGE AND AN ENGAGEMENT MEMBER ON A REAR OF THE TONER CARTRIDGE

(71) Applicant: LEXMARK INTERNATIONAL, INC., Lexington, KY (US)

(72) Inventors: Brian Scott Carpenter, Lexington, KY (US); Gregory Alan Cavill, Winchester, KY (US); James Richard Leemhuis, Lexington, KY (US); Jeffrey Lawrence Tonges, Versailles, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 17/023,858

(22) Filed: Sep. 17, 2020

(65) Prior Publication Data

US 2021/0003962 A1 Jan. 7, 2021

Related U.S. Application Data

(63) Continuation of application No. 16/429,471, filed on Jun. 3, 2019, now Pat. No. 10,809,661.

(51) Int. Cl.

| | |
|---|---|
| ***G03G 15/08*** | (2006.01) |
| ***G03G 21/18*** | (2006.01) |
| ***G03G 21/16*** | (2006.01) |

(52) U.S. Cl.

CPC ..... *G03G 21/1825* (2013.01); *G03G 15/0875* (2013.01); *G03G 21/1647* (2013.01); (Continued)

(58) Field of Classification Search

USPC ..... 399/113

See application file for complete search history.

(56) References Cited

U.S. PATENT DOCUMENTS 9,285,758 B1 * 3/2016 Boettcher ..... G03G 21/185
2006/0159487 A1 7/2006 Choi et al.
(Continued)

FOREIGN PATENT DOCUMENTS

EP 0810495 A1 12/1997

OTHER PUBLICATIONS

Extended European Search Report dated Oct. 22, 2020 for European Patent Application No. 20176276.2.

*Primary Examiner* — Quana Grainger
(74) *Attorney, Agent, or Firm* — Justin M. Tromp

(57) ABSTRACT

A toner cartridge according to one example includes first and second alignment guides that extend outward from a first side and a second side of the toner cartridge, respectively, for positioning the toner cartridge. The first and second alignment guides define a pivot axis about which the toner cartridge is pivotable relative to an imaging unit when the toner cartridge is installed on the imaging unit. An engagement member is positioned on a rear of the toner cartridge for receiving a bias force for biasing the toner cartridge about the pivot axis when the toner cartridge is installed on the imaging unit. The engagement member is positioned next to the bottom of the housing. The engagement member includes an angled contact surface that faces upward and rearward for contacting a corresponding hold-down on the imaging unit when the toner cartridge is installed on the imaging unit.

16 Claims, 11 Drawing Sheets

(52) U.S. Cl.
CPC ..... *G03G 2221/1657* (2013.01); *G03G 2221/1861* (2013.01)

(56) References Cited

U.S. PATENT DOCUMENTS

| | | | |
|---|---|---|---|
| 2009/0232554 | A1 | 9/2009 | Cook et al. |
| 2013/0170868 | A1 | 7/2013 | Acosta et al. |

* cited by examiner

TONER CARTRIDGE HAVING POSITIONING FEATURES INCLUDING GUIDES EXTENDING OUTWARD FROM SIDES OF THE TONER CARTRIDGE AND AN ENGAGEMENT MEMBER ON A REAR OF THE TONER CARTRIDGE

CROSS REFERENCES TO RELATED APPLICATIONS

This application is a continuation application of U.S. patent application Ser. No. 16/429,471, filed Jun. 3, 2019, entitled "Toner Cartridge Having Positioning Features Including Guides Extending Outward from Sides of the Toner Cartridge and an Engagement Member on a Rear of the Toner Cartridge."

BACKGROUND

1. Field of the Disclosure

The present disclosure relates generally to image forming devices and more particularly to a toner cartridge having positioning features.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device typically includes one or more replaceable units that have a shorter lifespan than the image forming device. For example, the image forming device's toner supply may be stored in a replaceable unit. A separate replaceable unit may include one or more imaging components having a relatively longer life than the toner supply. It is important that the replaceable unit(s) are precisely aligned within the image forming device. If a replaceable unit is misaligned, one or more input gears on the replaceable unit may fail to maintain proper gear mesh with corresponding output gears that provide rotational motion to the input gears on the replaceable unit and one or more electrical contacts on the replaceable unit may fail to maintain an electrical connection with corresponding electrical contacts that provide an electrical voltage to the electrical contacts on the replaceable unit. Further, if a replaceable unit is misaligned, various components of the replaceable unit (e.g., a developer roll, a photoconductive drum, a toner inlet or outlet) may be incorrectly positioned relative to corresponding components potentially resulting in toner leakage or print quality defects. The replaceable unit(s) must also be rigidly held in place after installation in the image forming device in order to prevent the positional alignment of the replaceable unit(s) from being disturbed during operation. The requirement for tight positional control must be balanced with the need to permit a user to easily load and unload the replaceable unit(s) into and out of the image forming device. Accordingly, it will be appreciated that precise alignment of the replaceable unit(s) and relatively simple insertion and removal of the replaceable unit(s) into and out of the image forming device is desired.

SUMMARY

A toner cartridge for use with an imaging unit in an image forming device according to one example embodiment includes a housing having a top, a bottom, a front and a rear positioned between a first side and a second side of the housing. The housing has a reservoir for holding toner. A developer roll is rotatably positioned on the housing. A portion of an outer surface of the developer roll is exposed along the front of the housing for supplying toner from the reservoir to a corresponding photoconductive drum of the imaging unit. An interface gear on the first side of the housing is rotatably coupled to the developer roll. At least a portion of the interface gear is exposed at the front of the housing for mating with a corresponding drive gear of the imaging unit and receiving rotational force from the corresponding drive gear of the imaging unit. A first alignment guide extends outward from the first side of the housing and a second alignment guide extends outward from the second side of the housing for positioning the toner cartridge on the imaging unit. The first and second alignment guides are spaced above the developer roll along the front of the housing. The first and second alignment guides define a pivot axis about which the toner cartridge is pivotable relative to the imaging unit when the toner cartridge is installed on the imaging unit. A first engagement member is positioned on the rear of the housing for receiving a bias force from a corresponding first hold-down on the imaging unit for biasing the toner cartridge about the pivot axis when the toner cartridge is installed on the imaging unit. The first engagement member is positioned closer to the first side of the housing than to the second side of the housing and is positioned next to the bottom of the housing. The first engagement member includes a first angled contact surface that faces upward and rearward for contacting the corresponding first hold-down on the imaging unit when the toner cartridge is installed on the imaging unit.

In some embodiments, the first alignment guide includes a first cylindrical post extending outward from the first side of the housing and the second alignment guide includes a second cylindrical post extending outward from the second side of the housing symmetrical to the first cylindrical post.

Some embodiments include a second engagement member on the rear of the housing for receiving a bias force from a corresponding second hold-down on the imaging unit for biasing the toner cartridge about the pivot axis when the toner cartridge is installed on the imaging unit. The second engagement member is positioned closer to the second side of the housing than to the first side of the housing and is positioned next to the bottom of the housing. The second engagement member includes a second angled contact surface that faces upward and rearward for contacting the corresponding second hold-down on the imaging unit when the toner cartridge is installed on the imaging unit. In some embodiments, the first angled contact surface and the second angled contact surface are oriented at different angles. For example, the first angled contact surface may be angled shallower vertically than the second angled contact surface and the second angled contact surface may be angled steeper vertically than the first angled contact surface. In some embodiments, the first angled contact surface is angled between 40 degrees and 55 degrees relative to a first imaginary line that extends from a rotational axis of the developer roll to a bottom point of a contact surface of the first alignment guide and the second angled contact surface is angled between 35 degrees and 60 degrees relative to a second imaginary line that extends from the rotational axis of the developer roll to a bottom point of a contact surface of the second alignment guide.

In some embodiments, the first engagement member includes a first angled lead-in surface that is positioned below the first angled contact surface and that faces downward and rearward for contacting the corresponding first hold-down on the imaging unit during installation of the toner cartridge onto the imaging unit.

In some embodiments, the first angled contact surface is angled between 40 degrees and 55 degrees relative to an imaginary line that extends from a rotational axis of the developer roll to a bottom point of a contact surface of the first alignment guide.

In some embodiments, the pivot axis defined by the first and second alignment guides is parallel to a rotational axis of the developer roll.

Some embodiments include a first spacer and a second spacer on the developer roll. The first spacer and the second spacer are positioned axially outboard of an elastomeric roll portion of the developer roll at opposite axial ends of the developer roll. A diameter of each of the first and second spacers is less than a diameter of the elastomeric roll portion of the developer roll when the elastomeric roll portion of the developer roll is in an uncompressed state.

Some embodiments include a projection that extends forward from the front of the housing at the second side of the housing for aligning the toner cartridge axially along a rotational axis of the developer roll relative to the imaging unit when the toner cartridge is installed on the imaging unit. The projection is positioned lower than at least a portion of the first alignment guide and the second alignment guide and higher than the developer roll. In some embodiments, the projection extends further forward than the developer roll.

A toner cartridge for use with an imaging unit in an image forming device according to another example embodiment includes a housing having a top, a bottom, a front and a rear positioned between a first side and a second side of the housing. The housing has a reservoir for holding toner. A developer roll is rotatably positioned on the housing. A portion of an outer surface of the developer roll is exposed along the front of the housing for supplying toner from the reservoir to a corresponding photoconductive drum of the imaging unit. An interface gear on the first side of the housing is mounted on the developer roll. At least a portion of the interface gear is exposed at the front of the housing for mating with a corresponding drive gear of the imaging unit and receiving rotational force from the corresponding drive gear of the imaging unit. A first guide post extends outward from the first side of the housing and a second guide post extends outward from the second side of the housing for positioning the toner cartridge on the imaging unit. The first and second guide posts are spaced above the developer roll along the front of the housing at the same height. A pivot axis about which the toner cartridge is pivotable relative to the imaging unit when the toner cartridge is installed on the imaging unit extends through the first and second guide posts. A first projection is positioned on the rear of the housing for receiving a bias force from a corresponding first hold-down on the imaging unit for biasing the toner cartridge about the pivot axis when the toner cartridge is installed on the imaging unit. The first projection is positioned closer to the first side of the housing than to the second side of the housing and is positioned immediately adjacent to the bottom of the housing. The first projection includes a first angled contact surface that faces upward and rearward for contacting the corresponding first hold-down on the imaging unit when the toner cartridge is installed on the imaging unit.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
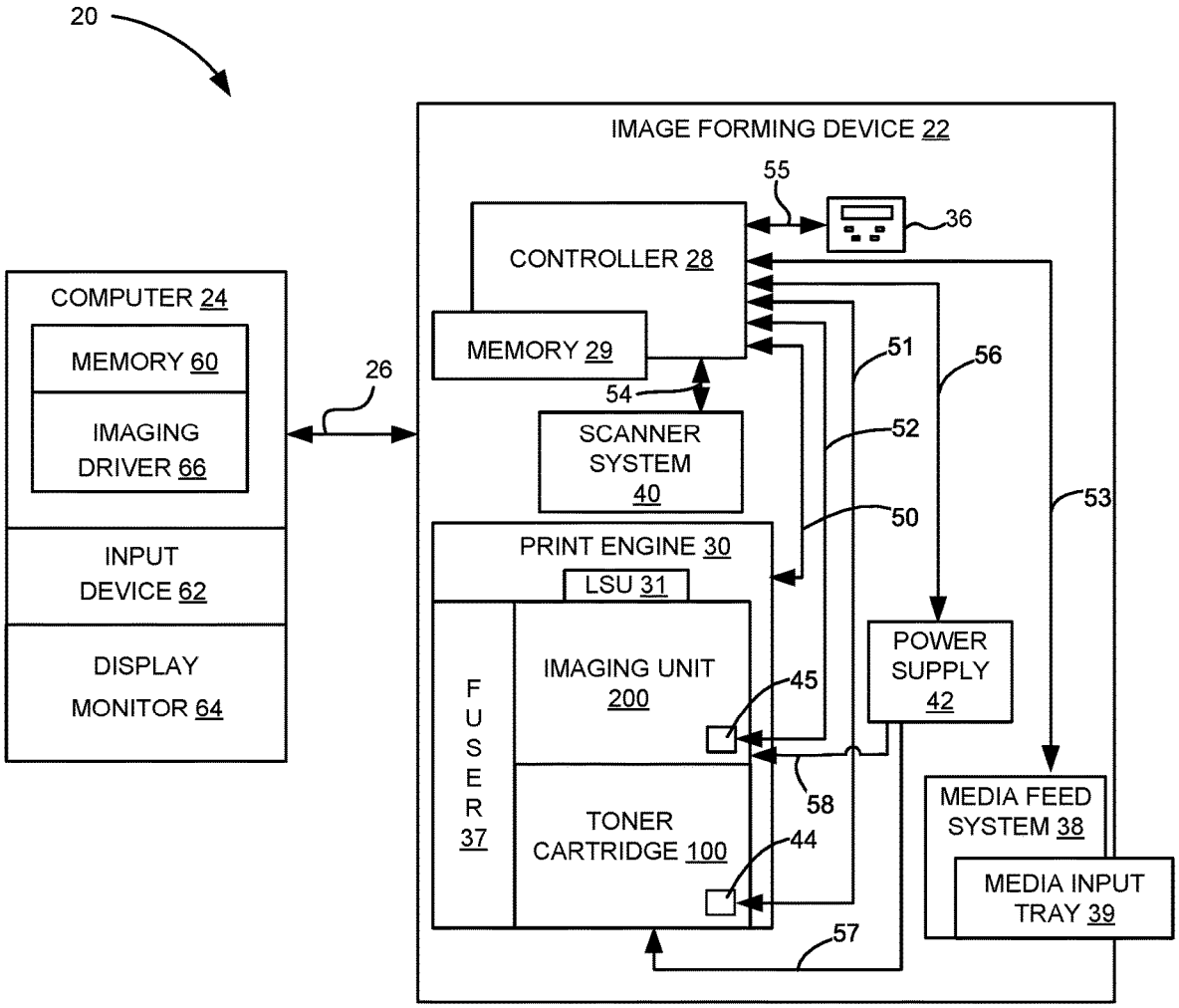
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, an imaging unit 200, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with imaging unit 200 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with power supply 42 via a communications link 56. Controller 28 processes print and scan data and operates print engine 30 during printing and scanner system 40 during scanning. Processing circuitry 44, 45 may provide authentication functions, safety and operational interlocks, operating parameters and usage information related to toner cartridge 100 and imaging unit 200, respectively. Each of processing circuitry 44, 45 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Toner cartridge 100 and imaging unit 200 are removably mounted in image forming device 22. Power supply 42 provides an electrical voltage to various components of toner cartridge 100 and imaging unit 200 via respective electrical paths 57 and 58. In one embodiment, toner cartridge 100 includes a developer unit that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of the developer unit is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, the developer unit includes a developer roll that attracts the magnetic carrier beads having toner thereon to the developer roll through the use of magnetic fields. In one embodiment, imaging unit 200 includes a photoconductor unit that houses a charge roll, a photoconductive drum and a waste toner removal system. Although the example image forming device 22 illustrated in FIG. 1 includes one toner cartridge and imaging unit, in the case of an image forming device configured to print in color, separate toner cartridges and imaging units may be used for each toner color. For example, in one embodiment, the image forming device includes four toner cartridges, each containing a particular toner color (e.g., black, cyan, yellow and magenta) to permit color printing, and four corresponding imaging units.

The electrophotographic printing process is well known in the art and, therefore, is described briefly herein. During a printing operation, laser scan unit 31 creates a latent image on the photoconductive drum in imaging unit 200. Toner is transferred from the toner reservoir in toner cartridge 100 to the latent image on the photoconductive drum by the developer roll to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
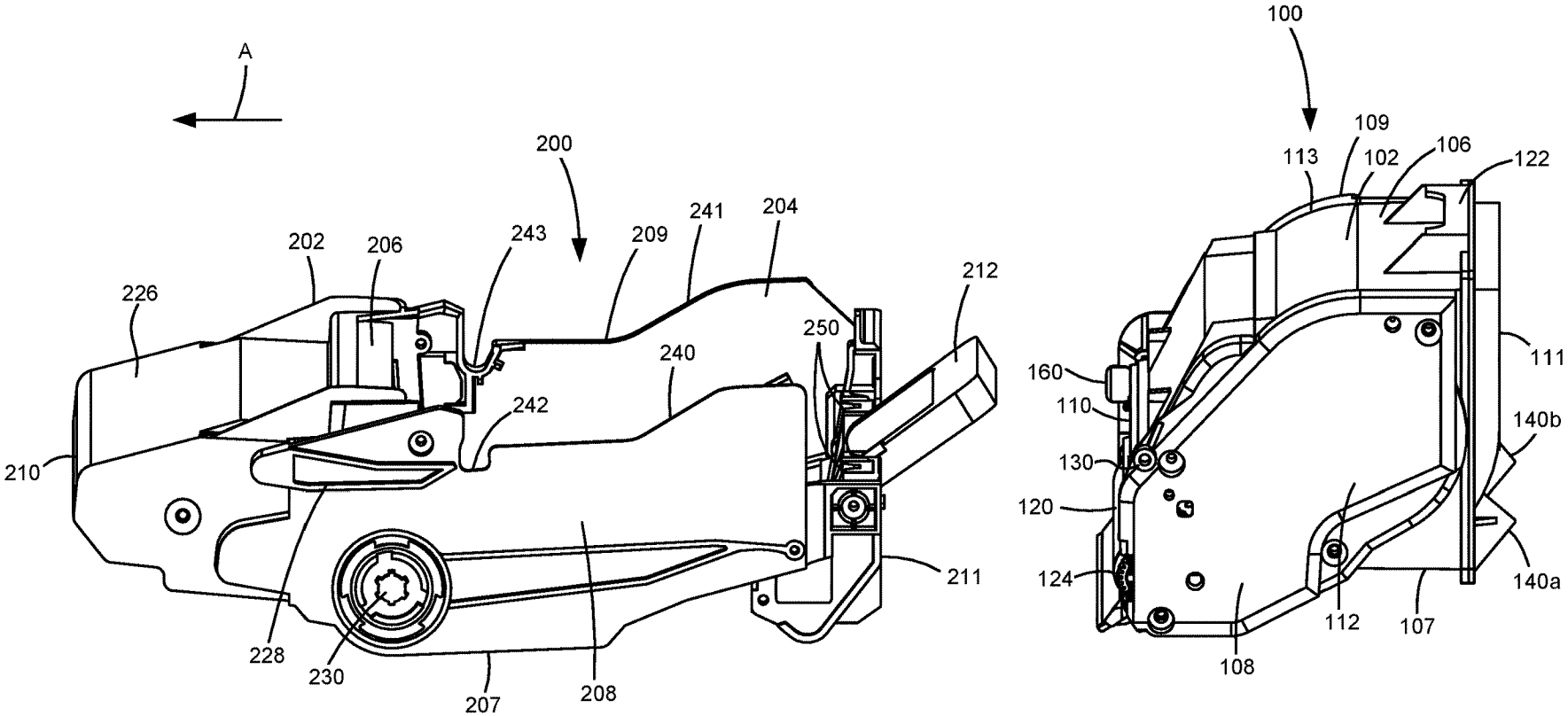
FIG. 2 is a perspective view of a toner cartridge and an imaging unit separated from each other according to one example embodiment.
Figure 3:
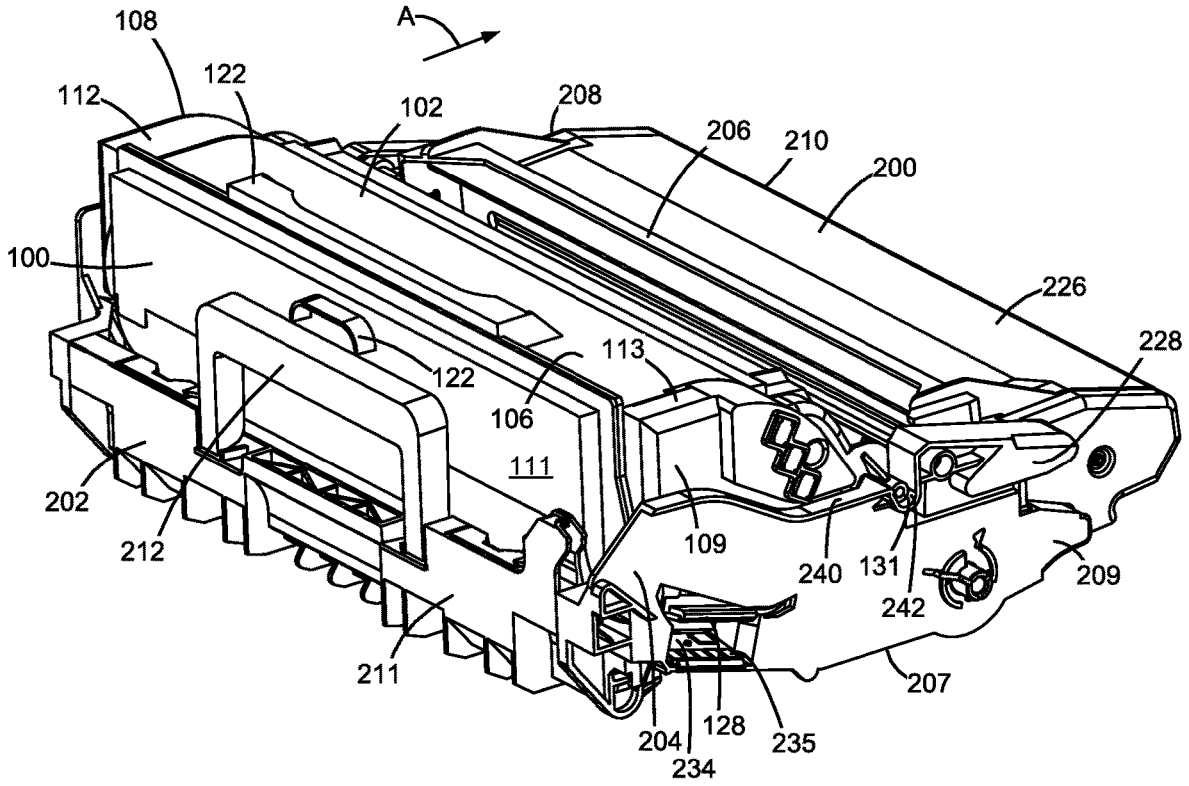
FIG. 3 is a perspective view of the toner cartridge and the imaging unit shown in FIG. 2 mated with each other according to one example embodiment.
Figure 4:
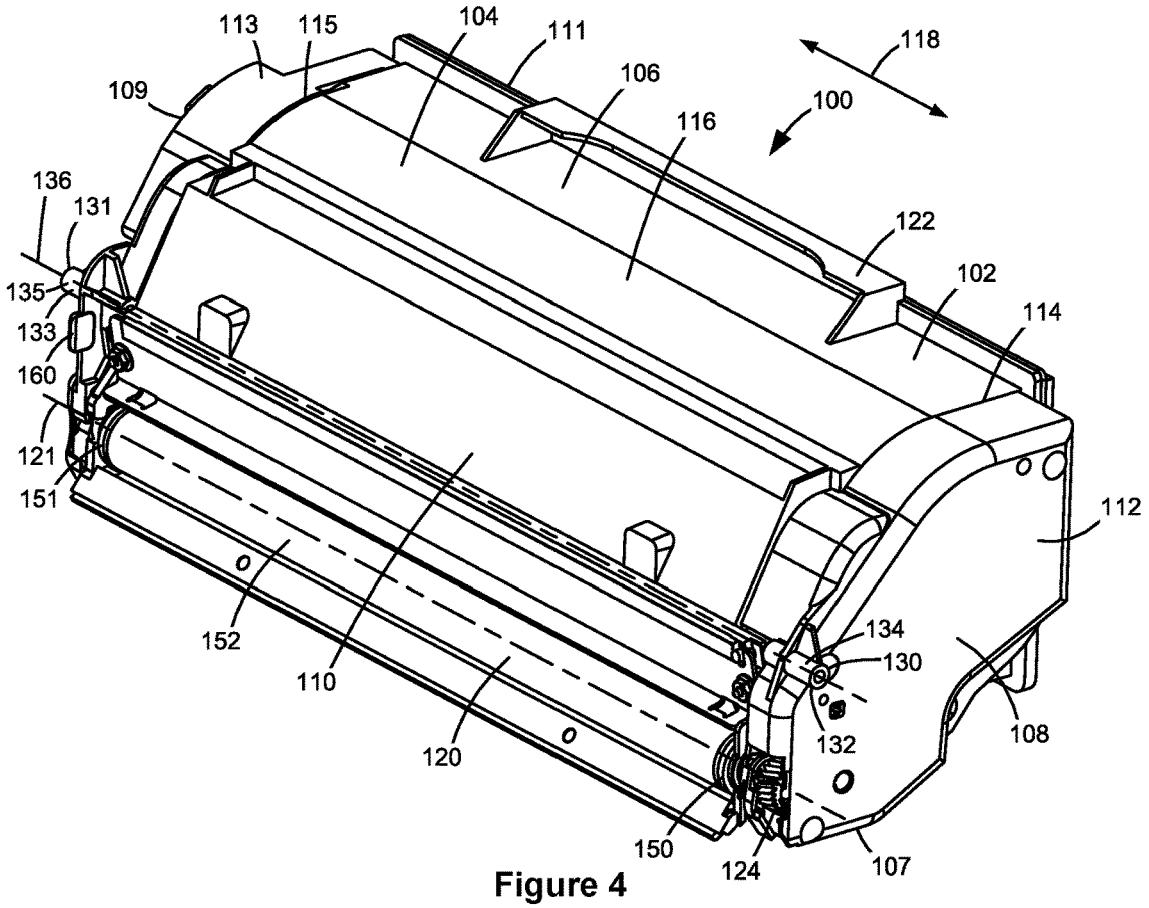
FIG. 4 is a front perspective view of the toner cartridge shown in FIGS. 2 and 3.

Referring now to FIGS. 2 and 3, toner cartridge 100 and imaging unit 200 are shown according to one example embodiment. As discussed above, toner cartridge 100 and imaging unit 200 are each removably installed in image forming device 22. Toner cartridge 100 is first installed on a frame 204 of imaging unit 200 and mated with imaging unit 200. Toner cartridge 100 and imaging unit 200 are then slidably inserted together into image forming device 22. FIG. 2 shows toner cartridge 100 and imaging unit 200 separated from each other and FIG. 3 shows toner cartridge 100 installed on imaging unit 200. The arrow A shown in FIGS. 2 and 3 indicates the direction of insertion of toner cartridge 100 and imaging unit 200 into image forming device 22. This arrangement allows toner cartridge 100 and imaging unit 200 to be easily removed from and reinstalled in image forming device 22 as a single unit, while permitting toner cartridge 100 and imaging unit 200 to be repaired or replaced separately from each other.

With reference to FIGS. 2-5, toner cartridge 100 includes a housing 102 having an enclosed reservoir 104 for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In the example embodiment illustrated, toner cartridge 100 includes a rotatable developer roll 120 having a rotational axis 121 that runs along a side-to-side dimension 118 of housing 102, from side 108 to side 109. A portion of developer roll 120 is exposed from housing 102 along front 110 of housing 102, near bottom 107 of housing 102 for delivering toner from toner cartridge 100 to a corresponding photoconductive drum 220 (FIG. 7) of imaging unit 200. In this manner, developer roll 120 forms an outlet for exiting toner from toner cartridge 100. A handle 122 may be provided on top 106 or rear 111 of housing 102 to assist with coupling and decoupling toner cartridge 100 to and from imaging unit 200 and insertion and removal of toner cartridge 100 and imaging unit 200 into and out of image forming device 22.

Toner cartridge 100 also includes an interface gear 124 positioned on side 108 of housing 102. In the embodiment illustrated, interface gear 124 mates with and receives rotational force from a corresponding drive gear on imaging unit 200 in order to provide rotational force to developer roll 120 and other rotatable components of toner cartridge 100 for moving toner to developer roll 120 when toner cartridge 100 is installed in image forming device 22. In the embodiment illustrated, interface gear 124 is mounted to a shaft of developer roll 120, coaxial with developer roll 120. In this embodiment, a front portion of interface gear 124 is exposed on the front 110 of housing 102, near bottom 107 of housing 102 and is unobstructed to mate with and receive rotational force from the corresponding drive gear on imaging unit 200. In the embodiment illustrated, interface gear 124 is rotatably connected to a drive train that is positioned between end cap 112 and side wall 114 of housing 102. The drive train aids in transferring rotational force from interface gear 124 to rotatable components of toner cartridge 100, including, for example, to a toner adder roll 126 (FIG. 6) that provides toner from reservoir 104 to developer roll 120 and to one or more toner agitators that move toner in reservoir 104 toward toner adder roll 126 and that agitate and mix the toner in reservoir 104. In the example embodiment illustrated, interface gear 124 is formed as a helical gear, but other configurations may be used as desired.

In the embodiment illustrated, toner cartridge 100 also includes an electrical connector 128 positioned on side 109 of housing 102 that includes one or more electrical contacts 129 that mate with corresponding electrical contacts in image forming device 22 when toner cartridge 100 is installed in image forming device 22 in order to facilitate communications link 51 between controller 28 of image forming device 22 and processing circuitry 44 of toner cartridge 100.

Toner cartridge 100 also includes an alignment guide 130, 131 extending outward from each side 108, 109 of housing 102. Alignment guides 130, 131 assist with mating toner cartridge 100 to imaging unit 200 and with positioning toner cartridge 100 relative to imaging unit 200 during operation in image forming device 22. Alignment guides 130, 131 are received by corresponding guides on imaging unit 200 that aid in positioning toner cartridge 100 relative to imaging unit 200 as discussed in greater detail below. Alignment guides 130, 131 are spaced above developer roll 120 along front 110 of housing 102, e.g., at the same height as each other and at the same position along a front-to-rear dimension of housing 102. In the example embodiment illustrated, an alignment guide 130, 131 is positioned on an outer side of each end cap 112, 113. In some embodiments, each alignment guide 130, 131 includes a rounded contact surface 132, 133. For example, in the embodiment illustrated, each alignment guide 130, 131 includes a cylindrical post 134, 135 extending outward from a respective side 108, 109 of housing 102, symmetrical to each other. In the embodiment illustrated, an imaginary line 136 that runs through each alignment guide 130, 131 is parallel to rotational axis 121 of developer roll 120.

Toner cartridge 100 also includes one or more engagement members 140 that receive a bias force from corresponding hold-downs on imaging unit 200 to retain toner cartridge 100 in its operative position on imaging unit 200 during operation. For example, the bias force received by engagement members 140 maintains contact between developer roll 120 and the corresponding photoconductive drum 220 on imaging unit 200 and between interface gear 124 and the corresponding drive gear on imaging unit 200. In the embodiment illustrated, the bias force received by engagement members 140 biases toner cartridge 100 rotationally relative to imaging unit 200 about imaginary line 136 through alignment guides 130, 131. In this manner, imaginary line 136 through alignment guides 130, 131 serves as a pivot axis 136 about which toner cartridge 100 is positioned relative to imaging unit 200.

In this embodiment, engagement members 140 are positioned on rear 111 of housing 102 next to or immediately adjacent to the bottom 107 of housing 102. The example embodiment illustrated includes a pair of engagement members 140*a*, 140*b*; however, other embodiments may include a single engagement member 140 or more than two engagement members 140 as desired. In the embodiment illustrated, engagement member 140*a* is positioned closer to side 108 than to side 109 and engagement member 140*b* is positioned closer to side 109 than to side 108. Other embodiments may include engagement member 140*a* positioned closer to side 108 than to side 109 but may omit engagement member 140*b* depending on the forces on toner cartridge 100 near side 108 relative to side 109 during operation. In the embodiment illustrated, each engagement member 140*a*, 140*b* is formed as a projection from rear 111 of housing 102, e.g., a substantially vertical fin or wing extending from rear 111 of housing 102. Each engagement member 140*a*, 140*b* includes a contact surface 142*a*, 142*b* that contacts the corresponding hold-down on imaging unit 200 when toner cartridge 100 is installed on imaging unit 200. Contact surfaces 142*a*, 142*b* are angled upward such that each contact surface 142*a*, 142*b* faces upwards and rearwards relative to housing 102, i.e., in a direction toward the top 106 of housing 102 and away from the rear 111 of housing 102 as illustrated. Each engagement member 140*a*, 140*b* may also include an angled lead-in surface 144*a*, 144*b* that facilitates engagement between engagement members 140*a*, 140*b* and the corresponding hold-downs on imaging unit 200 as discussed in greater detail below. Lead-in surfaces 144*a*, 144*b* are angled downward such that each lead-in surface 144*a*, 144*b* faces downwards and rearwards relative to housing 102, i.e., in a direction toward the bottom 107 of housing 102 and away from the rear 111 of housing 102 as illustrated.

Figure 5:
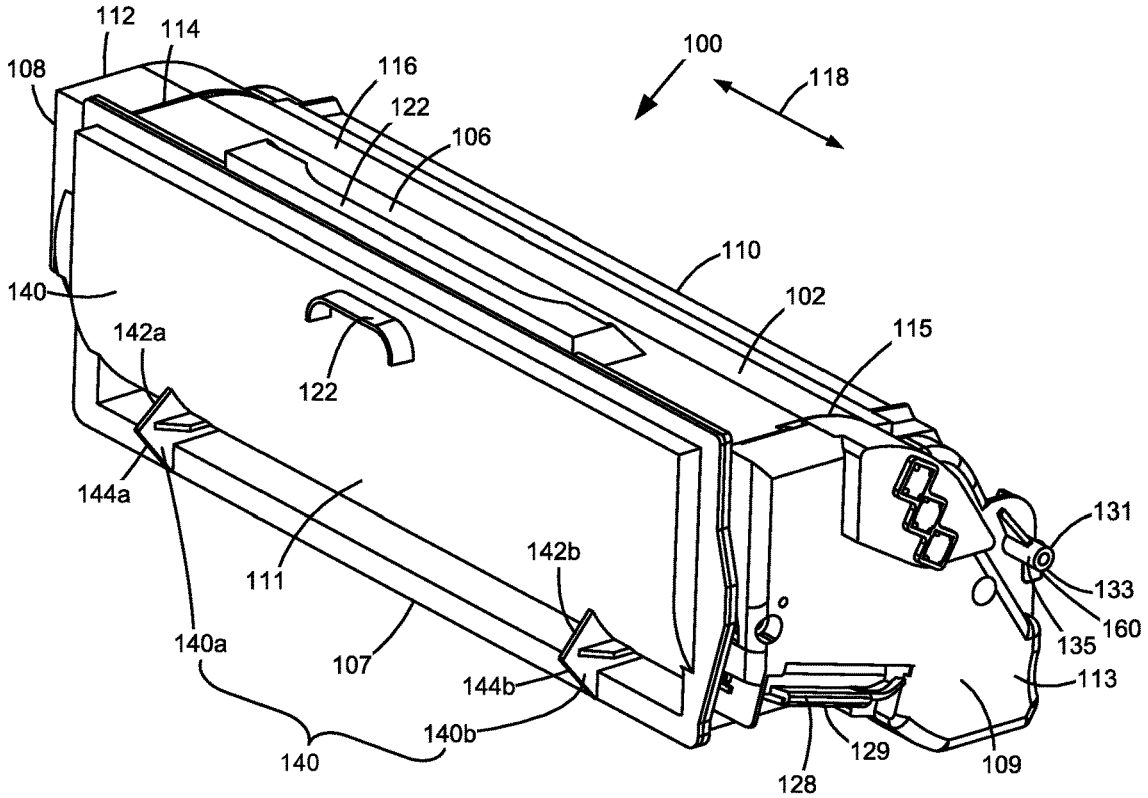
FIG. 5 is a rear perspective view of the toner cartridge shown in FIGS. 2-4.
Figure 6:
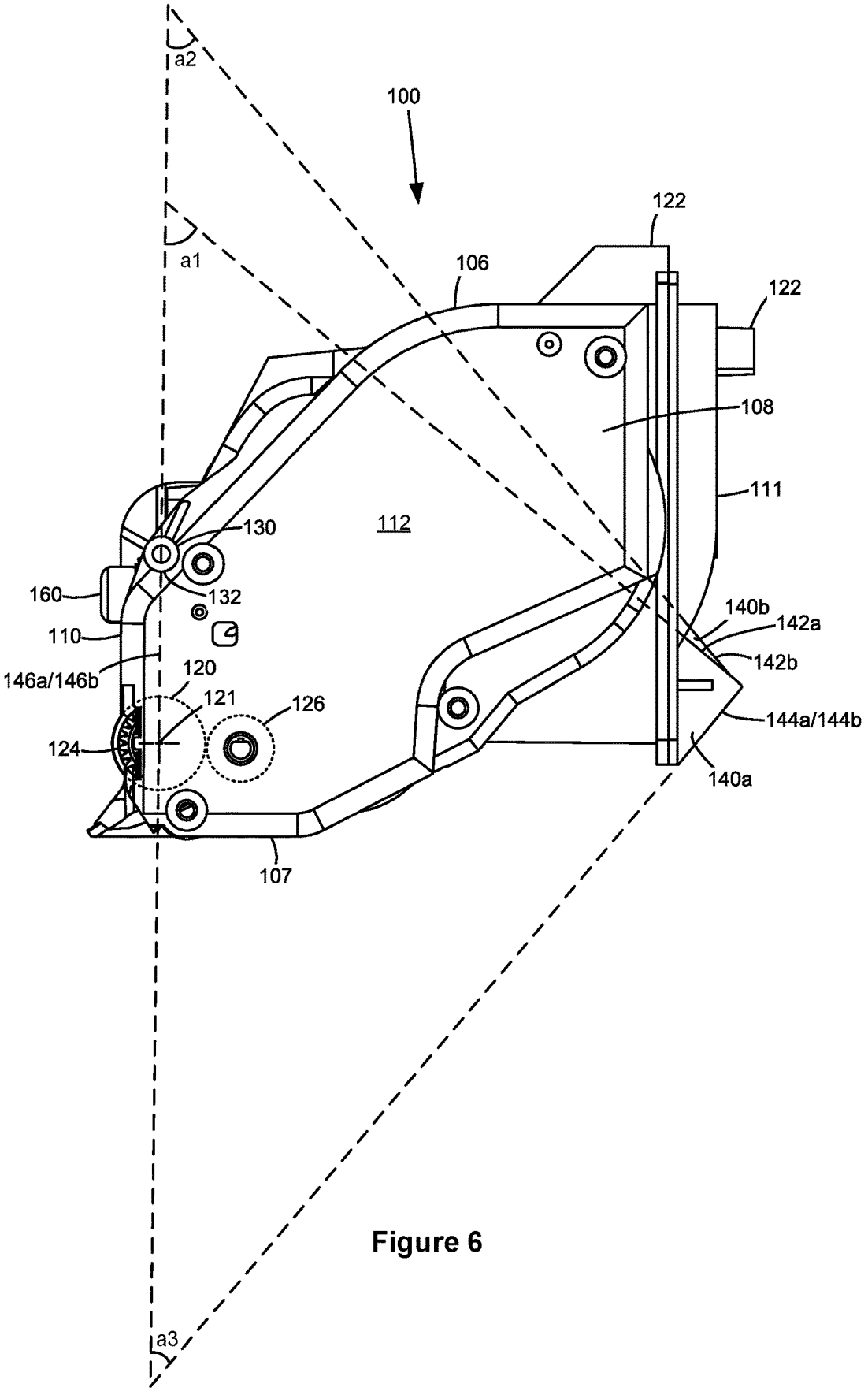
FIG. 6 is a side elevation view of the toner cartridge shown in FIGS. 2-5.

With reference to FIGS. 5 and 6, contact surfaces 142*a*, 142*b* of engagement members 140*a*, 140*b* may be oriented at the same angle or at different angles relative to each other as desired depending on the distribution of forces on toner cartridge 100 about pivot axis 136 near side 108 in comparison with near side 109. For example, in the embodiment illustrated, contact surfaces 142*a*, 142*b* are oriented at different angles with contact surface 142*a* angled shallower vertically than contact surface 142*b* and contact surface 142*b* angled steeper vertically than contact surface 142*a*. Similarly, lead-in surfaces 144*a*, 144*b* of engagement members 140*a*, 140*b* may be oriented at the same angle or at different angles relative to each other as desired. For example, in the embodiment illustrated, lead-in surfaces 144*a*, 144*b* are oriented at the same angle as each other.

In some embodiments, contact surface 142*a* of engagement member 140*a* is angled (angle a1) between 20 degrees and 70 degrees, e.g., between 40 degrees and 55 degrees, relative to an imaginary line 146*a* from rotational axis 121 of developer roll 120 to a bottom point of contact surface 132 of alignment guide 130 on side 108. In some embodiments, contact surface 142*b* of engagement member 140*b* is angled (angle a2) between 20 degrees and 70 degrees, e.g., between 35 degrees and 60 degrees, relative to an imaginary line 146*b* from rotational axis 121 of developer roll 120 to a bottom point of contact surface 133 of the alignment guide 131 on side 109. In some embodiments, lead-in surfaces 144*a*, 144*b* are angled (angle a3) between 20 degrees and 70 degrees, e.g., between 30 degrees and 50 degrees, relative to lines 146*a* and 146*b*, respectively.

Figure 7:
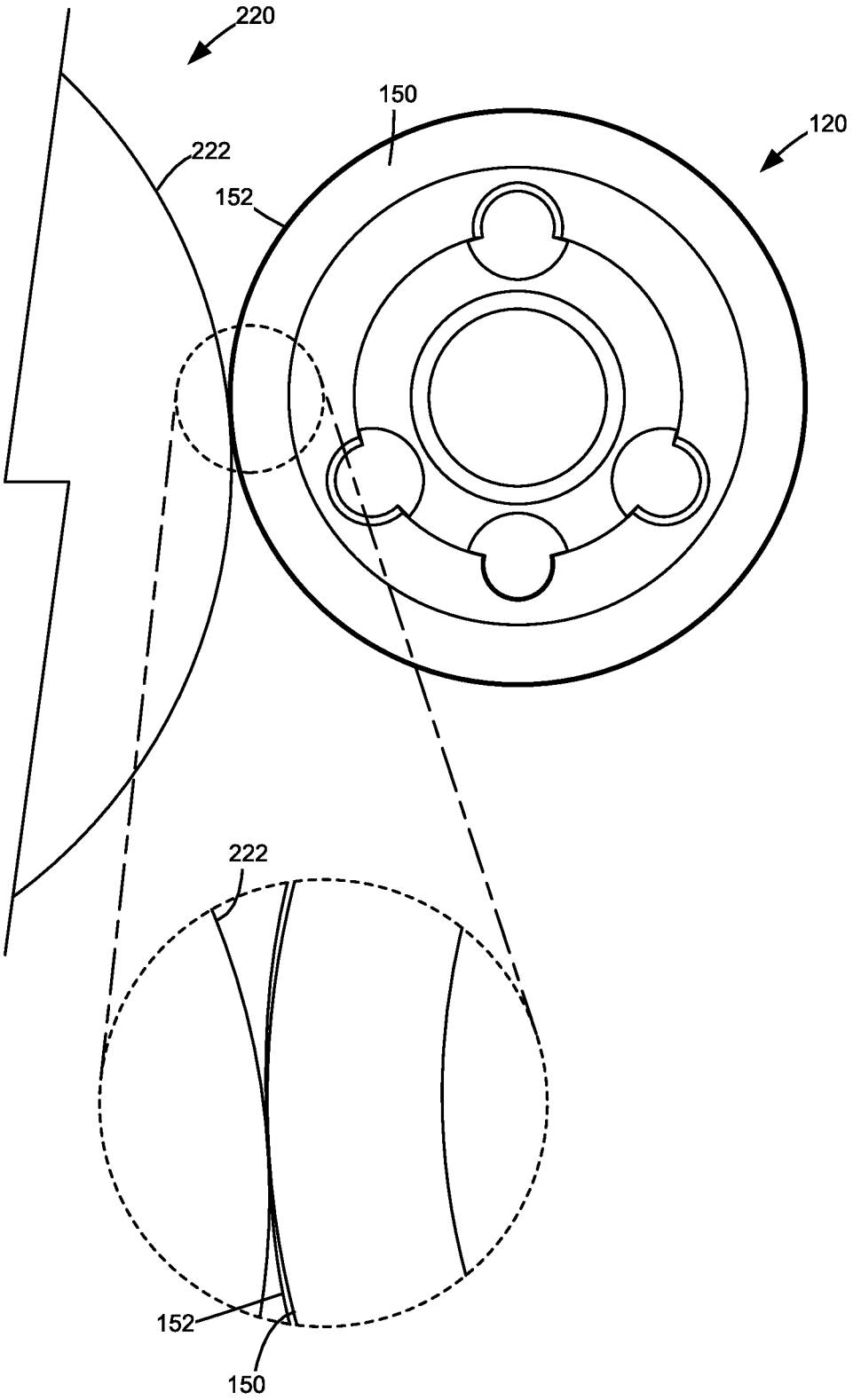
FIG. 7 is a schematic view of the engagement between a developer roll of the toner cartridge and a photoconductive drum of the imaging unit according to one example embodiment.
Figure 8:
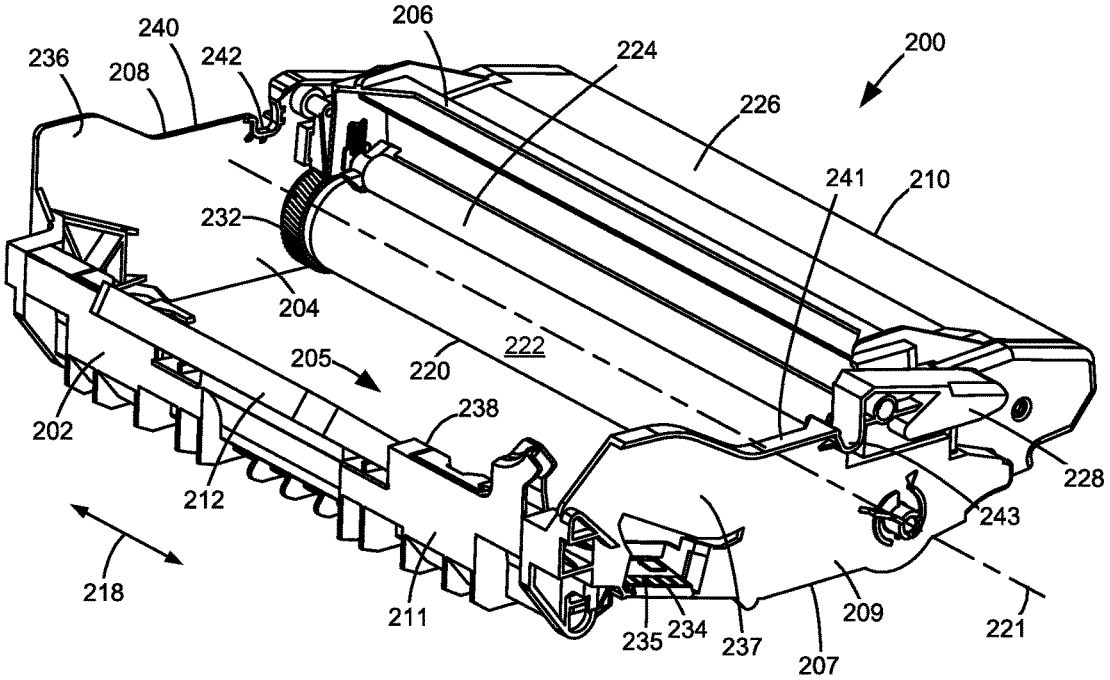
FIG. 8 is a rear perspective view of the imaging unit shown in FIGS. 2 and 3.
Figure 9:
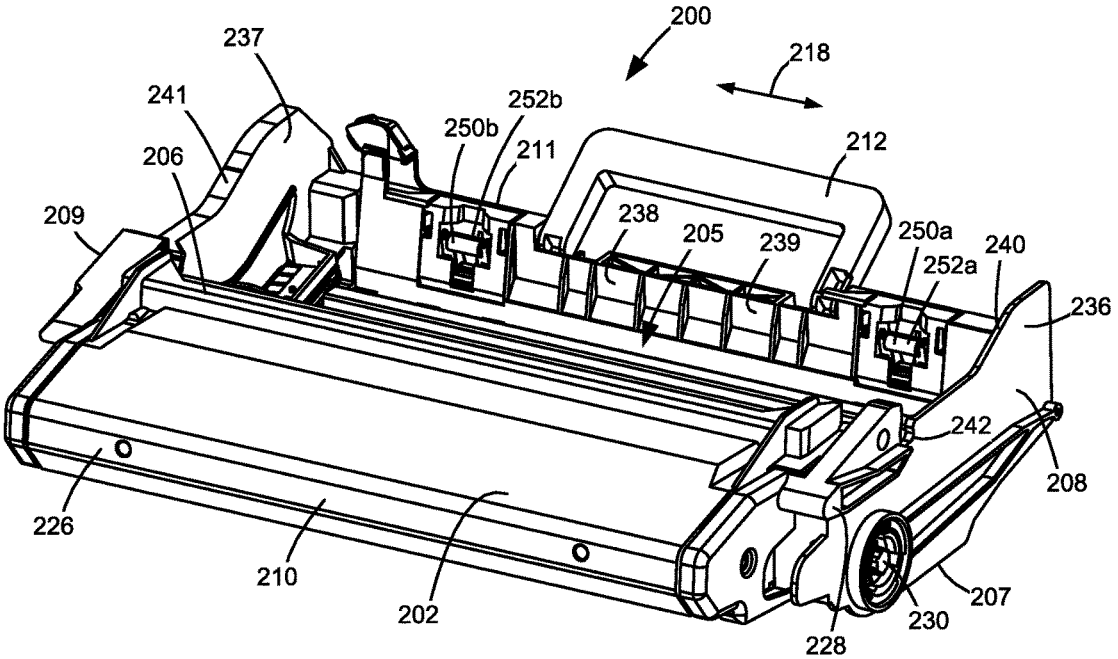
FIG. 9 is a front perspective view of the imaging unit shown in FIGS. 2, 3 and 8.

With reference back to FIG. 4, in some embodiments, toner cartridge 100 also includes a spacer 150, 151 mounted on each end of developer roll 120, axially outboard of an elastomeric roll portion 152 of developer roll 120 that carries toner from reservoir 104 to the corresponding photoconductive drum 220 of imaging unit 200. Spacers 150, 151 may be rotatable independent of developer roll 120 about rotational axis 121. As shown in FIG. 7, a diameter of each spacer 150, 151 is slightly less than (e.g., on the order of 0.1 mm less than) a diameter of elastomeric roll portion 152 of developer roll 120 when elastomeric roll portion 152 is in its normal, uncompressed state. The bias forces received by engagement members 140 press elastomeric roll portion 152 of developer roll 120 against an outer surface 222 of a photoconductive drum 220 of imaging unit 200 and compress elastomeric roll portion 152 of developer roll 120 until spacers 150, 151 contact outer surface 222 of photoconductive drum 220 as shown in the enlarged portion of FIG. 7. In this manner, spacers 150, 151 maintain a predetermined, fixed amount of interference between developer roll 120 and photoconductive drum 220. This configuration ensures consistent force at the nip formed between developer roll 120 and photoconductive drum 220. This, in turn, allows greater variation in the bias forces applied to engagement members 140 since, theoretically, application of a larger bias force does not increase the nip force between developer roll 120 and photoconductive drum 220.

In the example embodiment illustrated, toner cartridge 100 also includes a projection 160 that extends forward from front 110 of housing 102 at side 109 of housing 102. When toner cartridge 100 is installed on imaging unit 200, projection 160 is received by a corresponding slot on imaging unit 200. The engagement between projection 160 and the corresponding slot on imaging unit 200 aligns toner cartridge 100 along side-to-side dimension 118 of housing 102, axially along rotational axis 121 of developer unit 120, relative to imaging unit 200. In the embodiment illustrated, projection 160 is positioned lower than at least a portion of each alignment guide 130, 131 and higher than developer roll 120. As shown in FIG. 6, in the embodiment illustrated, projection 160 extends further forward than developer roll 120.

With reference to FIGS. 2, 3, 8 and 9, imaging unit 200 includes a housing 202 including a top 206, a bottom 207, first and second sides 208, 209, a front 210 and a rear 211. Front 210 of housing 202 leads during insertion of imaging unit 200 into image forming device 22 and rear 211 trails. In the embodiment illustrated, frame 204 includes a toner cartridge receiving area 205 positioned at rear 211 of housing 202. A handle 212 may be provided on rear 211 of housing 202, e.g., on frame 204, to assist with insertion and removal of toner cartridge 100 and imaging unit 200 into and out of image forming device 22.

In the example embodiment illustrated, imaging unit 200 includes a rotatable photoconductive drum 220 having a rotational axis 221 that runs along a side-to-side dimension 218 of housing 202, from side 208 to side 209. A rear portion of photoconductive drum 220 is open to toner cartridge receiving area 205 of frame 204 for receiving toner from developer roll 120 of toner cartridge 100. A bottom portion of photoconductive drum 220 is exposed from housing 202 on bottom 207 of housing 202. Toner on outer surface 222 of photoconductive drum 220 is transferred from the bottom portion of outer surface 222 of photoconductive drum 220 to a media sheet or intermediate transfer member during a print operation. Imaging unit 200 also includes a rotatable charge roll 224 in contact with outer surface 222 of photoconductive drum 220 that charges outer surface 222 of photoconductive drum 220 to a predetermined voltage. Imaging unit 200 also includes a waste toner removal system that may include a cleaner blade or roll that removes residual toner from outer surface 222 of photoconductive drum 220. In the example embodiment illustrated, imaging unit 200 includes a waste toner reservoir 226 positioned at the front 210 of housing 202. Waste toner reservoir 226 stores toner removed from photoconductive drum 220 by the cleaner blade or roll.

Sides 208, 209 may each include one or more alignment guides 228 that extend outward from the respective side 208, 209 to assist with insertion and removal of toner cartridge 100 and imaging unit 200 into and out of image forming device 22. Alignment guides 228 are received by corresponding guide rails in image forming device 22 that aid in positioning toner cartridge 100 and imaging unit 200 relative to image forming device 22.

Imaging unit 200 also includes a drive coupler 230 positioned on side 208 of housing 202. Drive coupler 230 mates with and receives rotational force from a corresponding drive coupler in image forming device 22 in order to provide rotational force to photoconductive drum 220 when imaging unit 200 is installed in image forming device 22. In the embodiment illustrated, drive coupler 230 is positioned at an axial end of photoconductive drum 220, coaxial with photoconductive drum 220. In this embodiment, an outer axial end of drive coupler 230 is exposed on side 208 of housing 202 and is unobstructed to mate with and receive rotational force from the corresponding drive coupler in image forming device 22. In the example embodiment illustrated, drive coupler 230 is configured to receive rotational force at the outer axial end of drive coupler 230, but other configurations may be used as desired. In some embodiments, charge roll 224 is driven by friction contact between the surfaces of charge roll 224 and photoconductive drum 220. In other embodiments, charge roll 224 is connected to drive coupler 230 by one or more gears.

In the embodiment illustrated, imaging unit 200 also includes a drive gear 232 attached to photoconductive drum 220, axially inboard of drive coupler 230. A portion of drive gear 232 is exposed to toner cartridge receiving area 205 of frame 204 permitting interface gear 124 of toner cartridge 100 to mate with drive gear 232 of imaging unit 200 when toner cartridge 100 is installed on frame 204 of imaging unit 200 to permit the transfer of rotational force received by drive coupler 230 of imaging unit 200 to interface gear 124 of toner cartridge 100 by way of drive gear 232 of imaging unit 200.

Imaging unit 200 also includes an electrical connector 234 positioned on a portion of frame 204 on side 209 of housing 202 that includes one or more electrical contacts 235 that mate with corresponding electrical contacts in image forming device 22 when imaging unit 200 is installed in image forming device 22 in order to facilitate communications link 52 between controller 28 of image forming device 22 and processing circuitry 45 of imaging unit 200.

Frame 204 of imaging unit 200 includes opposed side walls 236, 237 positioned at sides 208, 209 of housing 202, respectively, and a rear wall 238 positioned at rear 211 of housing 202. Side walls 236, 237 and rear wall 238 define toner cartridge receiving area 205 of frame 204. In the embodiment illustrated, a guide rail 240, 241 is positioned along a top surface of each side wall 236, 237. Guide rails 240, 241 receive alignment guides 130, 131 of toner cartridge 100 during installation of toner cartridge 100 onto imaging unit 200 and aid in guiding toner cartridge 100 to toner cartridge receiving area 205 of imaging unit 200 including guiding developer roll 120 toward photoconductive drum 220 as discussed in greater detail below. At least a portion of each guide rail 240, 241 slopes downward in a direction from rear 211 of housing 202 toward front 210 of housing 202 in order to urge toner cartridge 100 via gravity into toner cartridge receiving area 205 during installation of toner cartridge 100 onto imaging unit 200.

An alignment guide 242, 243 is positioned along a top surface of each side wall 236, 237 at a front portion of frame 204. Alignment guides 242, 243 contact corresponding alignment guides 130, 131 of toner cartridge 100 when toner cartridge 100 is fully installed on imaging unit 200 in order to position toner cartridge 100 relative to imaging unit 200 as discussed in greater detail below. In particular, contact between alignment guides 130, 131 of toner cartridge 100 and alignment guides 242, 243 of imaging unit 200 defines the location of pivot axis 136 relative to imaging unit 200 about which toner cartridge 100 is rotationally positioned relative to imaging unit 200. In the embodiment illustrated, alignment guides 242, 243 are positioned at the front of guide rails 240, 241. In this embodiment, alignment guides 242, 243 are formed as dwells or depressions that extend downward from guide rails 240, 241.

Frame 204 of imaging unit 200 includes at least one hold-down 250 that contacts and applies a bias force to the engagement member(s) 140 of toner cartridge 100. Hold-downs 250 are positioned at a rear portion of frame 204, such as on an inner side 239 of rear wall 238 of frame 204. The example embodiment illustrated includes a pair of hold-downs 250*a*, 250*b* corresponding to the pair of engagement members 140*a*, 140*b* of toner cartridge 100; however, other embodiments may include a single hold-down 250 or more than two hold-downs 250 depending on the configuration of the corresponding engagement member(s) 140 of toner cartridge 100. In the embodiment illustrated, hold-down 250*a* is positioned closer to side 208 than to side 209 of imaging unit 200 and hold-down 250*b* is positioned closer to side 209 than to side 208 of imaging unit 200. Hold-downs 250*a*, 250*b* are resiliently deflectable relative to frame 204 in order to supply a bias force to corresponding contact surfaces 142*a*, 142*b* of engagement members 140*a*, 140*b* of toner cartridge 100 that is normal to contact surfaces 142*a*, 142*b*. In the embodiment illustrated, each hold-down 250*a*, 250*b* includes a rod 252*a*, 252*b* that is pivotally mounted to rear wall 238 of frame 204 about a pivot axis 254 (FIGS. 12 and 13) and that is horizontally oriented. However, hold-downs 250*a*, 250*b* may take other suitable shapes and configurations and may be mounted in other orientations as desired. In the embodiment illustrated, each hold-down 250*a*, 250*b* is biased counterclockwise about pivot axis 254 as viewed in a direction from side 208 to side 209, i.e., biased toward photoconductive drum 220 and front 210 of housing 202, by a corresponding torsion spring 256*a*, 256*b* (FIGS. 11 and 12) positioned on frame 204. However, hold-downs 250*a*, 250*b* may be biased relative to frame 204 by any suitable mechanism including, for example, one or more compression springs, extension springs, leaf springs, or materials having resilient properties.

Figure 10:
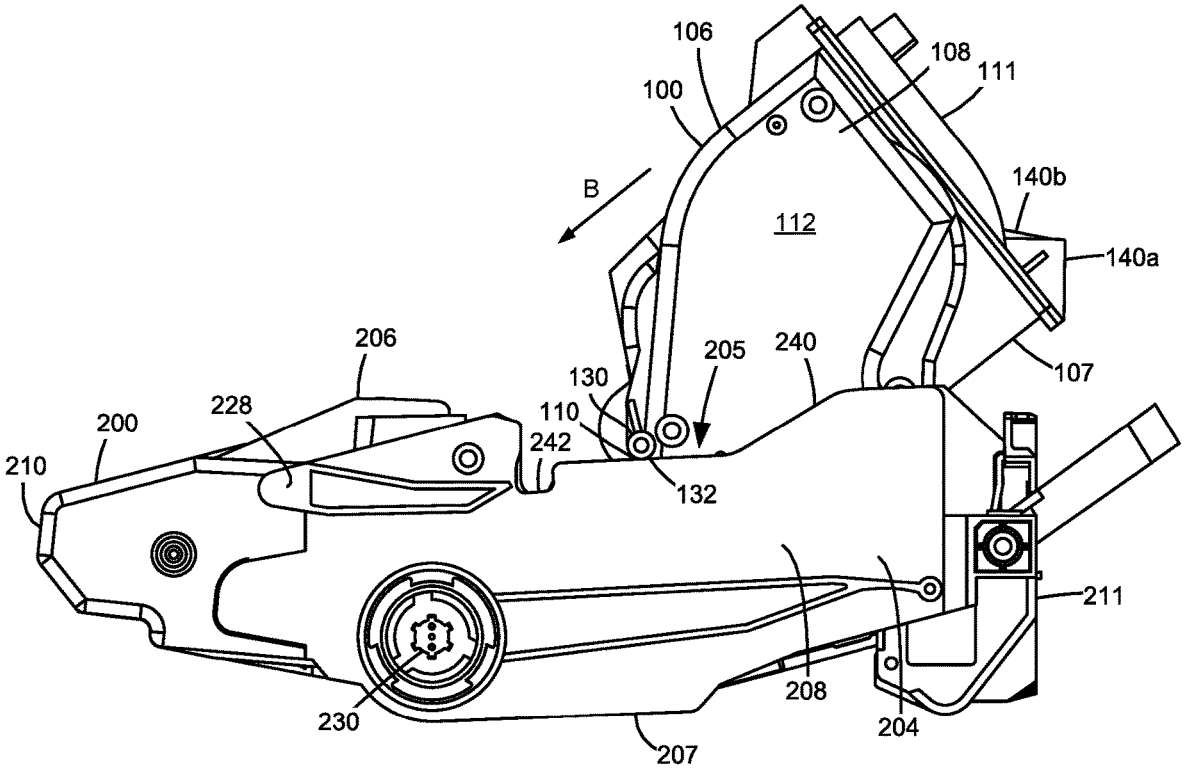
FIG. 10 is a side elevation view of the toner cartridge and the imaging unit during installation of the toner cartridge onto the imaging unit according to one example embodiment.
Figure 11:
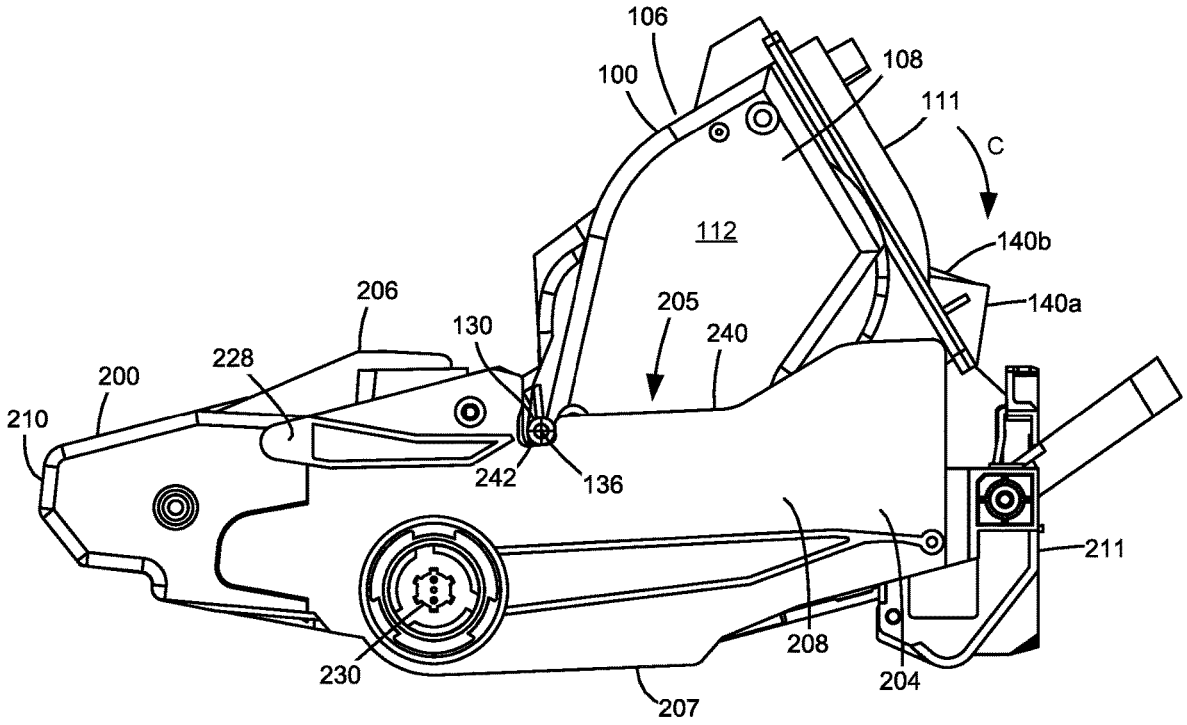
FIG. 11 is a side elevation view of the toner cartridge and the imaging unit during installation of the toner cartridge onto the imaging unit with the toner cartridge advanced from the position shown in FIG. 10 toward an installed position on the imaging unit.

FIGS. 10-13 are sequential views illustrating the installation of toner cartridge 100 onto imaging unit 200 according to one example embodiment. To install toner cartridge 100 onto imaging unit 200, the user lowers toner cartridge 100 into toner cartridge receiving area 205 formed by frame 204 of imaging unit 200. As toner cartridge 100 enters frame 204 of imaging unit 200, guide rails 240, 241 of imaging unit 200 contact alignment guides 130, 131 of toner cartridge 100 and aid in directing toner cartridge 100 into toner cartridge receiving area 205. For ease of use, in some embodiments, guide rails 240, 241 of imaging unit 200 are positioned to guide toner cartridge 100 into toner cartridge receiving area 205 regardless of where the user places alignment guides 130, 131 of toner cartridge 100 on guide rails 240, 241. FIG. 10 shows toner cartridge 100 advancing, as indicated by the arrow B in FIG. 10, forward relative to imaging unit 200, toward the front 210 of imaging unit 200, into toner cartridge receiving area 205 with alignment guide 130 of toner cartridge 100 in contact with guide rail 240 of imaging unit 200. Similarly, although obscured in FIG. 10, alignment guide 131 on side 109 of toner cartridge 100 is in contact with guide rail 241 on side 209 of imaging unit 200. Guide rails 240, 241 lead alignment guides 130, 131 of toner cartridge 100 toward alignment guides 242, 243 of imaging unit 200. Once alignment guides 130, 131 of toner cartridge 100 reach alignment guides 242, 243, alignment guides 130, 131 drop via gravity into alignment guides 242, 243 as shown in FIG. 11. After alignment guides 130, 131 of toner cartridge 100 lower into alignment guides 242, 243 of imaging unit 200, rear 111 of toner cartridge 100 pivots downward about pivot axis 136, clockwise as viewed in FIG. 11 as indicated by the arrow C, into toner cartridge receiving area 205.

Figure 12:
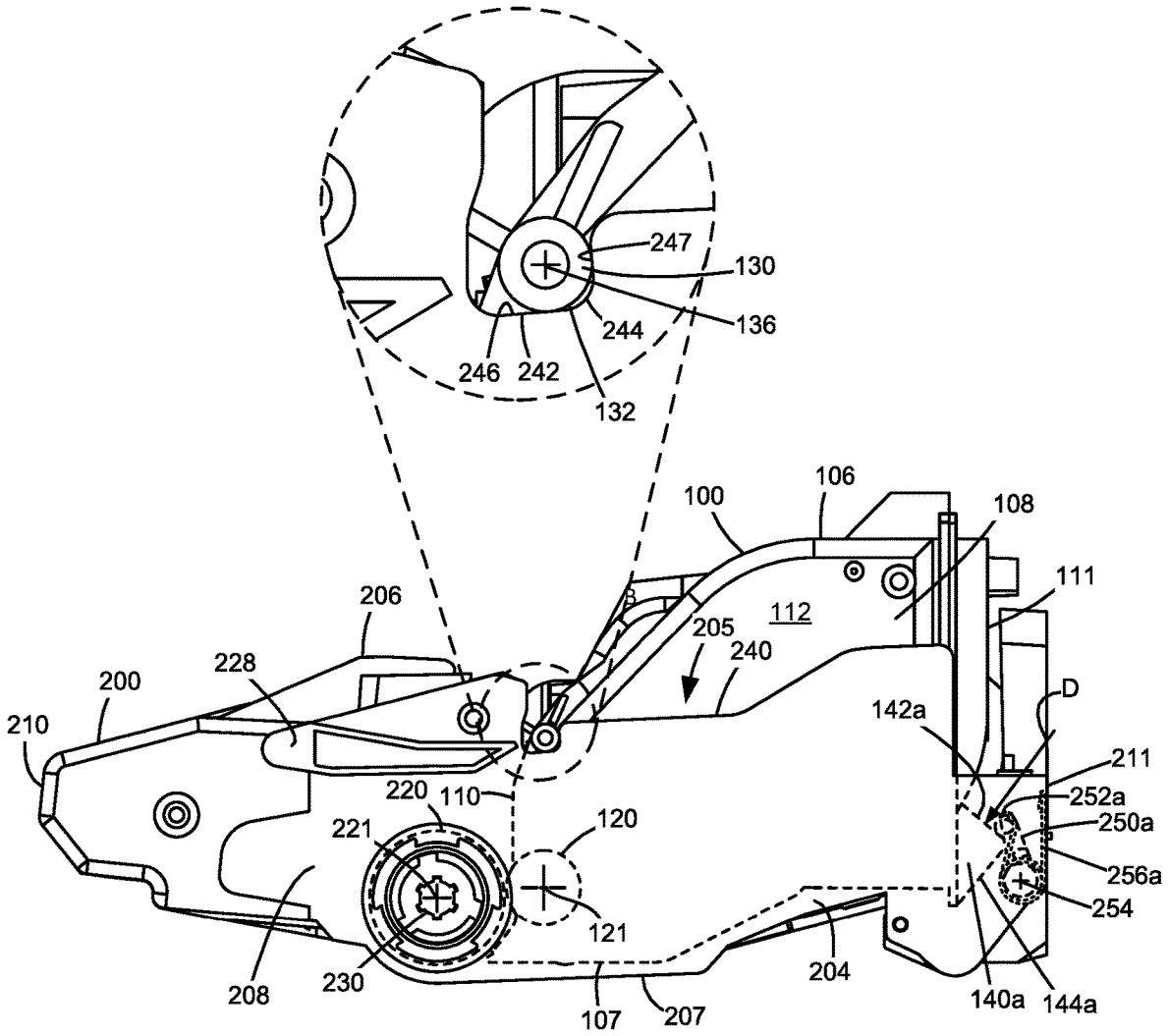
FIGS. 12 and 13 are first and second side elevation views of the toner cartridge installed on the imaging unit according to one example embodiment.
Figure 13:
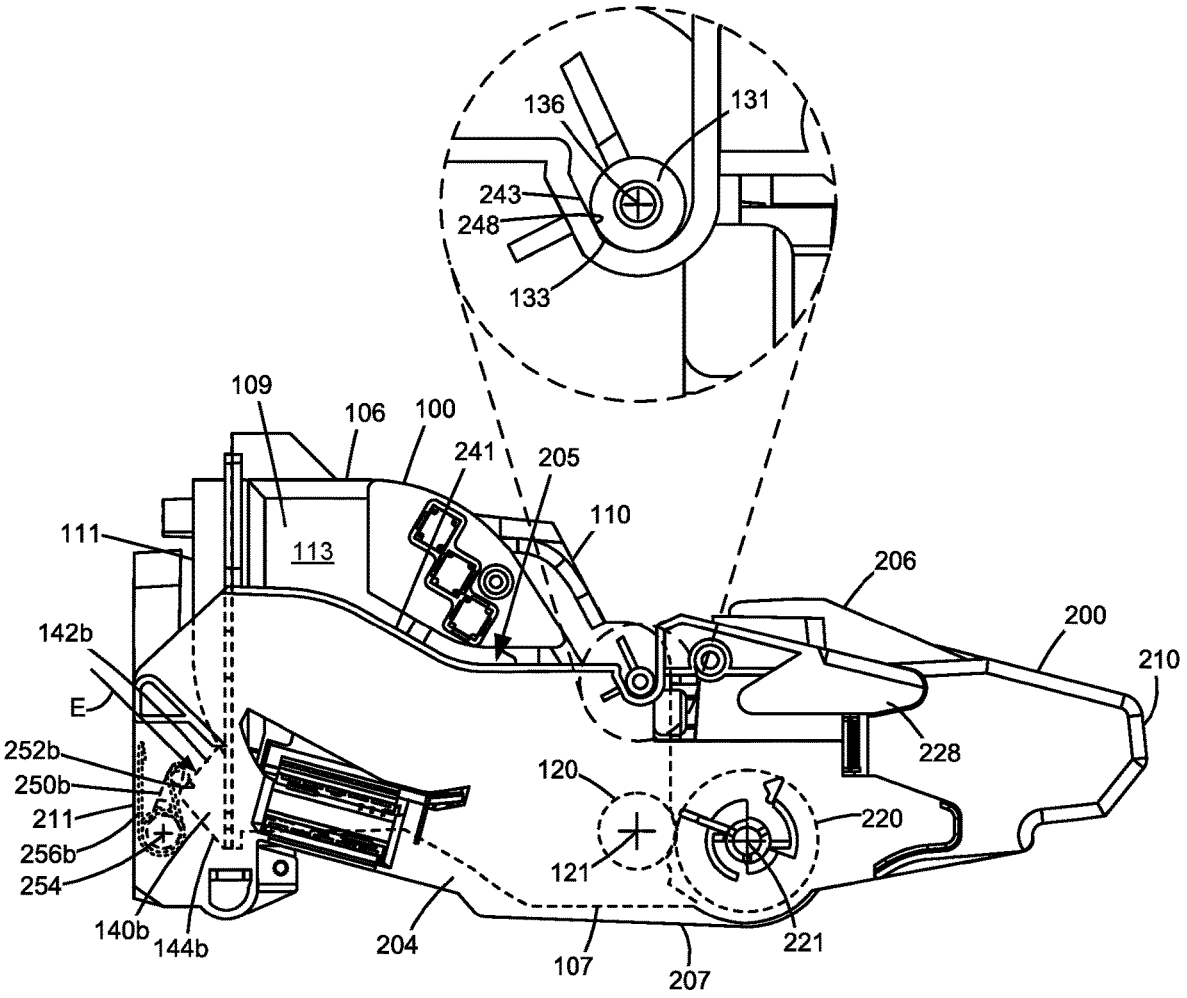

With reference to FIGS. 12 and 13, as rear 111 of toner cartridge 100 lowers into toner cartridge receiving area 205 of imaging unit 200, lead-in surfaces 144*a*, 144*b* of engagement members 140*a*, 140*b* contact hold-downs 250*a*, 250*b*. Portions of imaging unit 200, such as photoconductive drum 220 and hold-downs 250*a*, 250*b*, and toner cartridge 100, such as portions of housing 102, developer roll 120 and engagement members 140*a*, 140*b*, obscured by frame 204 of imaging unit 200 in FIGS. 12 and 13 are shown in dashed line. Contact between lead-in surfaces 144*a*, 144*b* of engagement members 140*a*, 140*b* and hold-downs 250*a*, 250*b* overcomes the bias applied to hold-downs 250*a*, 250*b* as rear 111 of toner cartridge 100 lowers into toner cartridge receiving area 205 causing hold-downs 250*a*, 250*b* to pivot about pivot axis 254 counter to the bias applied to hold-downs 250*a*, 250*b*, clockwise as viewed in FIG. 12 and counterclockwise as viewed in FIG. 13. As rear 111 of toner cartridge 100 lowers further into toner cartridge receiving area 205, lead-in surfaces 144*a*, 144*b* clear hold-downs 250*a*, 250*b* and hold-downs 250*a*, 250*b* begin to contact the contact surfaces 142*a*, 142*b* of engagement members 140*a*, 140*b*. As rear 111 of toner cartridge 100 lowers further into toner cartridge receiving area 205, hold-downs 250*a*, 250*b* pivot about pivot axis 254 as a result of the bias applied to hold-downs 250*a*, 250*b*, counterclockwise as viewed in FIG. 12 and clockwise as viewed in FIG. 13, maintaining contact with contact surfaces 142*a*, 142*b* of engagement members 140*a*, 140*b* through the remaining distance of travel of rear 111 of toner cartridge 100 into toner cartridge receiving area 205 of imaging unit 200.

FIGS. 12 and 13 show toner cartridge 100 fully installed on frame 204 of imaging unit 200. Hold-downs 250*a*, 250*b* each apply a bias force to the contact surface 142*a*, 142*b* of the corresponding engagement member 140*a*, 140*b* as indicated by the arrows D and E in FIGS. 12 and 13, respectively. The force applied to engagement members 140*a*, 140*b* by hold-downs 250*a*, 250*b* causes toner cartridge 100 to pivot relative to imaging unit 200 about pivot axis 136, clockwise as viewed in FIG. 12 and counterclockwise as viewed in FIG. 13, compressing elastomeric roll portion 152 of developer roll 120 against outer surface 222 of photoconductive drum 220 and pressing spacers 150, 151 into contact with outer surface 222 of photoconductive drum 220.

In the embodiment illustrated, alignment guide 242 on side 208 of imaging unit 200 includes a V-block 244 formed by an upward facing contact surface 246 and a forward facing contact surface 247 that is perpendicular to upward facing contact surface 246. When toner cartridge 100 is fully installed on frame 204 of imaging unit 200, contact surface 132 of alignment guide 130 contacts upward facing contact surface 246 and forward facing contact surface 247 of alignment guide 242 such that alignment guide 130 possesses only one degree of freedom in a plane perpendicular to rotational axis 121 of developer roll 120, rotation about pivot axis 136. This configuration uses the mechanical advantage provided by alignment guide 242 serving as a fulcrum at alignment guide 130 to amplify the nip force between developer roll 120 and photoconductive drum 220 in comparison with the bias force applied to contact surface 142*a* of engagement member 140*a* by hold-down 250*a*. The nip force is needed to overcome forces that would otherwise tend to separate developer roll 120 from photoconductive drum 220 such as forces from the gear mesh between drive gear 232 on imaging unit 200 and interface gear 124 on toner cartridge 100 and the compression force of elastomeric roll portion 152 of developer roll 120. In this manner, the mechanical advantage provided by the engagement between alignment guide 242 and alignment guide 130 helps maintain consistent contact between developer roll 120 and photoconductive drum 220.

In the embodiment illustrated, alignment guide 243 on side 209 of imaging unit 200 includes an inclined contact surface 248 that faces upward and forward. When toner cartridge 100 is fully installed on frame 204 of imaging unit 200, contact surface 133 of alignment guide 131 contacts inclined contact surface 248 of alignment guide 243 permitting toner cartridge 100 to pivot about pivot axis 136 and permitting alignment guide 131 to slide up and down inclined contact surface 248 in order to avoid over-constraining alignment guides 130, 131 of toner cartridge 100. Similar to the engagement between alignment guide 242 and alignment guide 130, the engagement between alignment guide 243 and alignment guide 131 provides a mechanical advantage to amplify the nip force between developer roll 120 and photoconductive drum 220 in comparison with the bias force applied to contact surface 142*b* of engagement member 140*b* by hold-down 250*b*. As discussed above, the nip force is needed to overcome forces that would otherwise tend to separate developer roll 120 from photoconductive drum 220, such as the compression force of elastomeric roll portion 152 of developer roll 120, in order to maintain consistent contact between developer roll 120 and photoconductive drum 220. In some embodiments, contact surface 248 of alignment guide 243 is angled between 35 degrees and 55 degrees relative to vertical in order to maintain contact between developer roll 120 and photoconductive drum 220.

Without the mechanical advantage provided by the engagement between alignment guides 242, 243 and alignment guides 130, 131, e.g., if toner cartridge 100 was translatable relative to imaging unit 200 instead of pivotable, a significantly higher bias force would be required in comparison with the bias force applied by hold-downs 250 to engagement members 140 in order to maintain sufficient nip force between developer roll 120 and photoconductive drum 220. The position of engagement members 140*a*, 140*b* next to bottom 107 of housing 102 helps optimize the mechanical advantage provided by the engagement between alignment guides 242, 243 and alignment guides 130, 131. If, on the other hand, engagement members 140*a*, 140*b* and corresponding hold-downs 150*a*, 150*b* were positioned higher up rear 111 of housing 102, a significantly larger bias force would be required on engagement members 140 to achieve the same nip force between developer roll 120 and photoconductive drum 220. While adjustment of the angles of contact surfaces 142*a*, 142*b* of engagement members 140*a*,

140*b* may help reduce the bias force required if engagement members 140*a*, 140*b* and corresponding hold-downs 150*a*, 150*b* were positioned higher up rear 111 of housing 102, this may have the adverse effect of impeding the separation of toner cartridge 100 from imaging unit 200 during replacement or repair of toner cartridge 100 and/or imaging unit 200 thereby requiring a more complex method for separating toner cartridge 100 from imaging unit 200.

In addition to lowering the bias force required to maintain sufficient nip force between developer roll 120 and photoconductive drum 220, the engagement between alignment guides 242, 243 and alignment guides 130, 131 also provides runout compliance to account for any eccentricities in the outer surface 222 of photoconductive drum 220. In operation, as photoconductive drum 220 and developer roll 120 rotate, any eccentricities in the outer surface 222 of photoconductive drum 220 tend to shift the position of spacer 150 and/or spacer 151 relative to rotational axis 221 of photoconductive drum 220. The engagement between alignment guides 242, 243 and alignment guides 130, 131 allows toner cartridge 100 to pivot relative to imaging unit 200 about pivot axis 136 in order to maintain contact between spacers 150, 151 and elastomeric roll portion 152 of developer roll 120 with the outer surface 222 of photoconductive drum 220 as a result of the bias applied to engagement members 140 by hold-downs 150.

Although the example embodiment discussed above includes a pair of replaceable units in the form of a toner cartridge 100 that includes the main toner supply for the image forming device and the developer unit and an imaging unit 200 that includes the photoconductor unit for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device, the developer unit and the photoconductor unit are provided in a single replaceable unit. Other configurations may be used as desired.

Further, it will be appreciated that the architecture and shape of toner cartridge 100 and imaging unit 200 illustrated is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use with an imaging unit in an image forming device, comprising:

a housing having a top, a bottom, a front and a rear positioned between a first side and a second side of the housing, the housing has a reservoir for holding toner;

a developer roll rotatably positioned on the housing, a portion of an outer surface of the developer roll is exposed along the front of the housing for supplying toner from the reservoir to a corresponding photoconductive drum of the imaging unit;

an interface gear on the first side of the housing rotatably coupled to the developer roll, at least a portion of the interface gear is exposed at the front of the housing for mating with a corresponding drive gear of the imaging unit and receiving rotational force from the corresponding drive gear of the imaging unit;

a first alignment guide extending outward from the first side of the housing and a second alignment guide extending outward from the second side of the housing for positioning the toner cartridge on the imaging unit, the first and second alignment guides are spaced above the developer roll along the front of the housing, the first and second alignment guides define a pivot axis about which the toner cartridge is pivotable relative to the imaging unit when the toner cartridge is installed on the imaging unit;

a first engagement member on the rear of the housing and a second engagement member on the rear of the housing for receiving respective first and second bias forces from corresponding first and second hold-downs on the imaging unit for biasing the toner cartridge about the pivot axis when the toner cartridge is installed on the imaging unit, the first engagement member is positioned closer to the first side of the housing than to the second side of the housing and is positioned next to the bottom of the housing, the second engagement member is positioned closer to the second side of the housing than to the first side of the housing and is positioned next to the bottom of the housing, the first engagement member includes a first angled contact surface that faces upward and rearward for contacting the corresponding first hold-down on the imaging unit when the toner cartridge is installed on the imaging unit, the second engagement member includes a second angled contact surface that faces upward and rearward for contacting the corresponding second hold-down on the imaging unit when the toner cartridge is installed on the imaging unit; and a projection that extends forward from the front of the housing at the second side of the housing for aligning the toner cartridge axially along a rotational axis of the developer roll relative to the imaging unit when the toner cartridge is installed on the imaging unit, the projection is positioned lower than at least a portion of the first alignment guide and at least a portion of the second alignment guide and higher than the developer roll.

2. The toner cartridge of claim 1, wherein the first alignment guide includes a first cylindrical post extending outward from the first side of the housing and the second alignment guide includes a second cylindrical post extending outward from the second side of the housing symmetrical to the first cylindrical post.

3. The toner cartridge of claim 1, wherein the first angled contact surface and the second angled contact surface are oriented at different angles.

4. The toner cartridge of claim 3, wherein the first angled contact surface is angled shallower vertically than the second angled contact surface and the second angled contact surface is angled steeper vertically than the first angled contact surface.

5. The toner cartridge of claim 1, wherein the first angled contact surface is angled between 40 degrees and 55 degrees relative to a first imaginary line that extends from the rotational axis of the developer roll to a bottom point of a contact surface of the first alignment guide and the second angled contact surface is angled between 35 degrees and 60 degrees relative to a second imaginary line that extends from the rotational axis of the developer roll to a bottom point of a contact surface of the second alignment guide.

6. The toner cartridge of claim 1, wherein the first engagement member includes a first angled lead-in surface that is positioned below the first angled contact surface and that faces downward and rearward for contacting the corresponding first hold-down on the imaging unit during installation of the toner cartridge onto the imaging unit, wherein the second engagement member includes a second angled lead-in surface that is positioned below the second angled contact surface and that faces downward and rearward for contacting the corresponding second hold-down on the imaging unit during installation of the toner cartridge onto the imaging unit.

7. The toner cartridge of claim 1, wherein the pivot axis defined by the first and second alignment guides is parallel to the rotational axis of the developer roll.

8. The toner cartridge of claim 1, further comprising a first spacer and a second spacer on the developer roll, the first spacer and the second spacer are positioned axially outboard of an elastomeric roll portion of the developer roll at opposite axial ends of the developer roll, a diameter of each of the first and second spacers is less than a diameter of the elastomeric roll portion of the developer roll when the elastomeric roll portion of the developer roll is in an uncompressed state.

9. The toner cartridge of claim 1, wherein the projection extends further forward than the developer roll.

10. A toner cartridge for use with an imaging unit in an image forming device, comprising:

a housing having a top, a bottom, a front and a rear positioned between a first side and a second side of the housing, the housing has a reservoir for holding toner;

a developer roll rotatably positioned on the housing, a portion of an outer surface of the developer roll is exposed along the front of the housing for supplying toner from the reservoir to a corresponding photoconductive drum of the imaging unit;

an interface gear on the first side of the housing rotatably coupled to the developer roll, at least a portion of the interface gear is exposed at the front of the housing for mating with a corresponding drive gear of the imaging unit and receiving rotational force from the corresponding drive gear of the imaging unit;

a first alignment guide extending outward from the first side of the housing and a second alignment guide extending outward from the second side of the housing for positioning the toner cartridge on the imaging unit, the first and second alignment guides are spaced above the developer roll along the front of the housing, the first and second alignment guides define a pivot axis about which the toner cartridge is pivotable relative to the imaging unit when the toner cartridge is installed on the imaging unit; and a first engagement member on the rear of the housing and a second engagement member is on the rear of the housing for receiving respective first and second bias forces from corresponding first and second hold-downs on the imaging unit for biasing the toner cartridge about the pivot axis when the toner cartridge is installed on the imaging unit, the first engagement member is positioned closer to the first side of the housing than to the second side of the housing and is positioned next to the bottom of the housing, the second engagement member is positioned closer to the second side of the housing than to the first side of the housing and is positioned next to the bottom of the housing, the first engagement member includes a first angled contact surface that faces upward and rearward for contacting the corresponding first hold-down on the imaging unit when the toner cartridge is installed on the imaging unit, the second engagement member includes a second angled contact surface that faces upward and rearward for contacting the corresponding second hold-down on the imaging unit when the toner cartridge is installed on the imaging unit, the first engagement member includes a first angled lead-in surface that is positioned below the first angled contact surface and that faces downward and rearward for contacting the corresponding first hold-down on the imaging unit during installation of the toner cartridge onto the imaging unit, the second engagement member includes a second angled lead-in surface that is positioned below the second angled contact surface and that faces downward and rearward for contacting the corresponding second hold-down on the imaging unit during installation of the toner cartridge onto the imaging unit.

11. The toner cartridge of claim 10, wherein the first alignment guide includes a first cylindrical post extending outward from the first side of the housing and the second alignment guide includes a second cylindrical post extending outward from the second side of the housing symmetrical to the first cylindrical post.

12. The toner cartridge of claim 10, wherein the first angled contact surface and the second angled contact surface are oriented at different angles.

13. The toner cartridge of claim 12, wherein the first angled contact surface is angled shallower vertically than the second angled contact surface and the second angled contact surface is angled steeper vertically than the first angled contact surface.

14. The toner cartridge of claim 10, wherein the first angled contact surface is angled between 40 degrees and 55 degrees relative to a first imaginary line that extends from a rotational axis of the developer roll to a bottom point of a contact surface of the first alignment guide and the second angled contact surface is angled between 35 degrees and 60 degrees relative to a second imaginary line that extends from the rotational axis of the developer roll to a bottom point of a contact surface of the second alignment guide.

15. The toner cartridge of claim 10, wherein the pivot axis defined by the first and second alignment guides is parallel to a rotational axis of the developer roll.

16. The toner cartridge of claim 10, further comprising a first spacer and a second spacer on the developer roll, the first spacer and the second spacer are positioned axially outboard of an elastomeric roll portion of the developer roll at opposite axial ends of the developer roll, a diameter of each of the first and second spacers is less than a diameter of the elastomeric roll portion of the developer roll when the elastomeric roll portion of the developer roll is in an uncompressed state.

* * * * *